US007448101B2

(12) United States Patent
Millar

(10) Patent No.: US 7,448,101 B2
(45) Date of Patent: Nov. 11, 2008

(54) SUPPORT STRUCTURE FOR EDEMA RELIEF

(76) Inventor: Heather E. Millar, 27 Frost Fish Cove, Harpswell, ME (US) 04079

( * ) Notice: Subject to any disclaimer, the term of this patent is extended or adjusted under 35 U.S.C. 154(b) by 0 days.

(21) Appl. No.: 11/543,445

(22) Filed: Oct. 5, 2006

(65) Prior Publication Data

US 2007/0083142 A1 Apr. 12, 2007

Related U.S. Application Data

(60) Provisional application No. 60/725,762, filed on Oct. 12, 2005.

(51) Int. Cl.
*A47C 20/00* (2006.01)

(52) U.S. Cl. ..... 5/646; 5/652; 5/655.9

(58) Field of Classification Search ..... 5/646, 5/647, 655, 652, 655.9, 901, 653
See application file for complete search history.

(56) References Cited

U.S. PATENT DOCUMENTS

| | | | | |
|---|---|---|---|---|
| 4,270,235 | A * | 6/1981 | Gutmann | 5/646 |
| 5,029,351 | A * | 7/1991 | Weber | 5/655 |
| 5,079,790 | A * | 1/1992 | Pouch | 5/630 |
| 5,134,740 | A * | 8/1992 | Summer | 5/652 |
| 6,279,185 | B1 * | 8/2001 | Matthews | 5/655 |
| 6,523,202 | B2 * | 2/2003 | Loomos | 5/653 |
| 2006/0272096 | A1 * | 12/2006 | Yoo | 5/652 |

* cited by examiner

*Primary Examiner*—Michael Trettel
(74) *Attorney, Agent, or Firm*—Howard M. Gitten; Edwards Angell Palmer & Dodge LLP

(57) ABSTRACT

A cushion for edema relief having a distal end and a proximal end. The distal end having a first height and the proximal end having a second height, the height of the distal end being greater than the height of the proximal end. An angled surface extends from the distal end to the proximal end being adapted to receive an extremity and an associated limb lying thereon.

3 Claims, 1 Drawing Sheet

SUPPORT STRUCTURE FOR EDEMA RELIEF

CROSS-REFERENCE TO RELATED APPLICATIONS

This Application is a Non-Provisional of Provisional Application No. application 60/725,762 filed on Oct. 12, 2005 (35 USC 119(e)).

BACKGROUND OF THE INVENTION

This invention is directed to relieving edema, and in particular, providing a simplified structure for use by patients to reduce edema in the upper extremities.

Many patients experience upper extremity edema in acute care settings and post surgery. Edema is the swelling caused by abnormal accumulation of fluid in body tissues. Edema may be caused by the distribution and transport of fluid throughout the body. Most bodily fluids are exchanged between the capillaries and the spaces that surround the cells. In a healthy situation, there is a balance of pressure maintained between the fluid in the capillaries and the fluid outside the capillaries, known as interstitial fluid. Edema occurs when this balance of pressure is disrupted and an excess of fluid flows out of the capillaries and into the interstitial space.

Edema may also result from trauma to the systems that maintain the homeostasis of fluids in the body. The causes may be burns, cuts, bumps and bruises, all of which may damage the delicate capillary tissues, which control the flow of pressure into and out of the interstitial spaces. As a result, inflammation occurs. Chemicals and bacteria invading the body may also damage the capillaries to cause edema. Kidney failure, protein deficiency, pregnancy, as well as the use of vasodilators are also causes of edema. Accordingly, edema is a significant issue in post surgery and acute care situations.

If left untreated, edema influences the muscle's ability to contract, places pressure on the nerves, blood vessels and various joint structures, delays healing and causes pain and stiffness. Therefore, prevention and treatment of edema is critical to maintain joint and muscle function. If left untreated, edema may lead to fibrosis, contracture, pain and an inability to perform functional tasks.

It is known in the art to treat edema in the upper extremities by active range of motion for fluid absorption and soft tissue mobility. Tissue is compressed through retrograde massage, wrapping or pressure garments. Another treatment method is the use of ice for vasoconstriction. These methods have the goal of increasing lymphatic and venous drainage from the hand as one extremity.

Elevation is also a known treatment for edema. The structures used to provide elevation require a significant assembly of mechanical parts, including springs and pulleys for elevation. As a result, patients tend not to use these devices as they are difficult to use, mechanically cumbersome and limited in their mobility and access.

To overcome this deficiency in the prior art, it is known in the art to, assemble a doughnut or ring-shape of pillows and adhesive tape for use in post surgery. The extremity for which edema is to be prevented or reduced is placed above one pillow while at least a second pillow is placed above the extremity and taped to the lower pillow to form a "doughnut" shape about the extremity. This prior art device has been satisfactory, however, it is bulky, requires some assembly which may be difficult to do if more than one extremity is involved, requires an excessive amount of material (at least two pillows), or if repeated assembly is not required, repeated adjustment may be, as the extremity is inserted repetitively into the doughnut degrading the doughnut through wear and tear. Furthermore, for patients who are not cognitively intact, the pillows tend to shift and/or fall on the floor. Lastly, it is very difficult for edema inflicted patients to assemble the pillow on their own.

Accordingly, an extremity support for reducing edema, which overcomes the shortcomings of the prior art, is desired.

BRIEF SUMMARY OF THE INVENTION

A method and apparatus for treating edema in upper extremities is provided. A cushion has a proximal end with a first height and a distal end having a second height, the distal and height being less than the proximal end height. An angled surface extends from the proximal end to the distal end. An extremity for which edema is to be relieved is placed at the distal end of the cushion with the connected limb lying on the angled surface.

In a preferred embodiment, the cushion has a cutout region adapted to receive the torso of the user and the angled surface is textured. The textured surface includes a plurality of elevated regions to form an "egg crate" texture.

During use, for hand treatment in particular, the user is in a seated position or in an L-shaped lying position so that the cushion rests on the lap of the user, with the user torso being received in the cutout position. The extremity to be treated is placed at the distal end of the cushion with the connected limb lying on the angled surface extending towards the distal end.

BRIEF DESCRIPTION OF THE DRAWINGS

For a fuller understanding of the invention, reference is had to the following description taken in connection with the accompanying drawings in which.

DETAILED DESCRIPTION OF THE INVENTION

Figure 3:
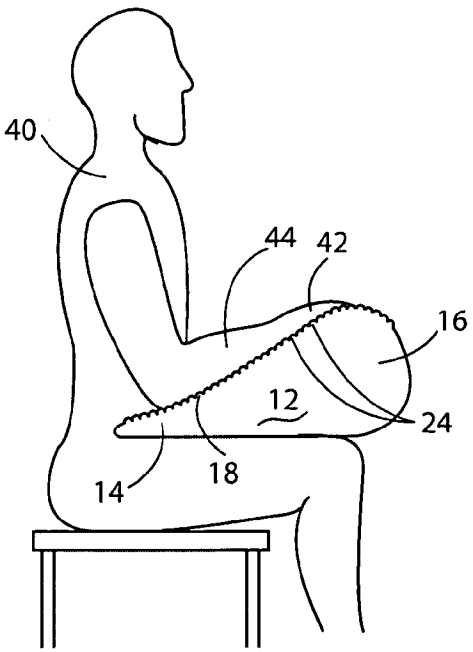
FIG. 3 is a side plan view of the cushion used in accordance with the method of the invention.
Figure 2:
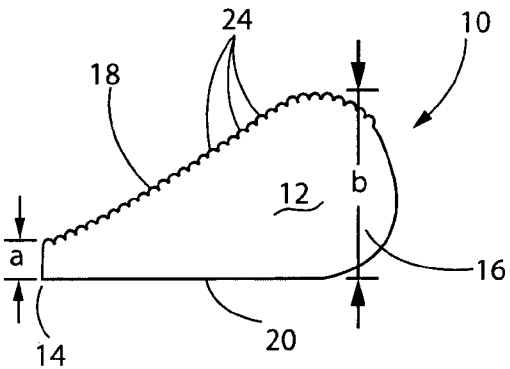
FIG. 2 is a side elevation view of a cushion constructed in accordance with the invention.
Figure 1:
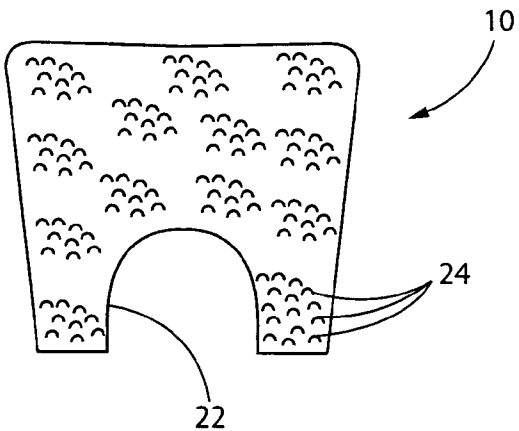
FIG. 1 is a top plan view of a cushion constructed in accordance with the invention.

Reference is made to FIGS. 1 and 2 in which a cushion, generally indicated as 10, is shown. Cushion 10 includes a body 12 having a proximal end 14, having a first height a and having a distal end 16, having a second height b. Height b is greater than height a. Because of the difference in height, at least one surface 18 is angled from proximal end 14 to distal end 16. In a preferred embodiment, a second opposed surface 20 is substantially flat so that cushion 12 has a wedge-shape.

In a preferred embodiment, although not necessary, cushion 10 includes a cutout portion 22 dimensioned to receive a torso of a user. Additionally, surface 18 is textured so as to have an uneven surface to provide contrasting sections of high and low pressure. In a preferred embodiment, surface 18 is formed with a plurality of projections 24 to have an inverted "egg crate" like structure. However, alternating spaced ridges, or the like, may work as well.

Cushion 10 is formed of a material, which allows some compression, but is sufficiently rigid to provide support without substantial body 12 deformity so that surface 18 continuously remains inclined and the texture of the surface does not become planar. A preferred material would be foam, but harder materials such as plastics or the like may be used. If sufficiently thick, softer materials such as feathers, granulized filler or the like may be used as long as cutout section 22 maintains its shape, or cushion 10 may be formed about the torso of the user, and the height b is maintained sufficiently greater than height a to induce the edema relieving effect. The size and firmness of cushion 10 are selected in accordance with the condition of the patient being treated.

During use, a user 40 is in an upright position; either seated or in an L-shaped configuration if lying in the bed. In other words, the torso is at a substantial right angle with the thighs to form a lap. Cushion 10 is placed on the lap of user 40 so that a torso of user 40 is within cutout section 22. The extremity to be treated, a hand in this instance, is placed at distal end 16 on angled surface 18 of cushion 10. The remainder of the limb associated with the extremity such as forearm 44 is also disposed along angled surface 18 and extends from distal end 16 to proximal end 14 so as to be angled.

By fitting around the torso, cushion 10 is anchored and does not shift very easily and maintains the extremity in the elevated position; the cushion is anchored by limb 44 and the user's torso. By placing the torso within the cushion at distal end 16, user 40 is aided in sitting up as limb 44 and the shoulder of the user provides support to the torso aiding in postural support of user 40. The use of a textured surface offers alternating pressure to the extremity 42 and limb 44 to prevent skin and tissue breakdown while facilitating the drainage of lymphatic fluid. By anchoring cushion 10 between the torso of user 40 and limb 44, there is increased comfort to the user as it maintains the sitting or upright position and, the anchoring of the body increases compliance with use. In other words, shifting is less likely to occur. Furthermore, the anchoring makes use easy in its setup and maintenance further ensuring compliance.

Thus while there have been shown, described and pointed out novel features of the present invention as applied to preferred embodiments thereof, it will be understood that various omissions and substitutions and change in the form and detail are contemplated so that the disclosed invention may be made by those skilled in the art without departing from the spirit and scope of the invention. It is the intention therefore, to be limited only as indicated by the scope of the claims appended hereto. It is also to be understood that the following claims are intended to cover all of the generic and specific features of the invention herein described and all statements of the scope of the invention, which as a matter of language might be said to fall therebetween.

What is claimed as new and desired to be protected by Letters Patent of the United States is:

1. A cushion for edema relief, said cushion comprising:

a body having a distal end and a proximal end; the distal end having a first height and the proximal end having a second height, the first height being greater than the second;

an angled surface, said angled surface being textured; and extending from said distal end to said proximal end adapted to receive an extremity and an associated limb lying thereon; and a cut-out formed in said body adapted to receive the torso of a user to maintain a user in an upright position.

2. The cushion of claim 1, wherein the angled surface is formed as an egg crate pattern.

3. A method for relieving edema for an extremity comprising the steps of:

providing a cushion having a proximal end with a first height and distal end with a second height, the second height being greater than the first height, and an angled textured surface extending from the proximal end to the distal end;

maintaining a user in an upright position by positioning at least a portion of said cushion about a torso of a user;

placing an extremity of a user at the distal end; and laying a limb associated with said extremity on said angled surface.

* * * * *